US006999919B2

(12) United States Patent
Layeghi et al.

(10) Patent No.: US 6,999,919 B2
(45) Date of Patent: Feb. 14, 2006

(54) FAST CONVERGENCE METHOD FOR BIT ALLOCATION STAGE OF MPEG AUDIO LAYER 3 ENCODERS

(75) Inventors: Shahab Layeghi, Redwood City, CA (US); Fahri Surucu, Fremont, CA (US)

(73) Assignee: Intervideo, Inc., Fremont, CA (US)

( * ) Notice: Subject to any disclaimer, the term of this patent is extended or adjusted under 35 U.S.C. 154(b) by 593 days.

(21) Appl. No.: 09/790,029

(22) Filed: Feb. 20, 2001

(65) Prior Publication Data

US 2001/0032086 A1 Oct. 18, 2001

Related U.S. Application Data

(60) Provisional application No. 60/183,764, filed on Feb. 18, 2000.

(51) Int. Cl.
*G10L 19/00* (2006.01)

(52) U.S. Cl. ..... 704/200.1; 704/230; 704/229

(58) Field of Classification Search ..... 704/500, 704/501, 502, 503, 504, 200.1, 229–230; 375/240.03, 240.18, 240.12, 240.13, 240.02
See application file for complete search history.

(56) References Cited

U.S. PATENT DOCUMENTS 5,164,828 A * 11/1992 Tahara et al. ..... 375/240.13
5,625,746 A 4/1997 Lim
5,627,938 A * 5/1997 Johnston ..... 704/200.1
5,682,463 A * 10/1997 Allen et al. ..... 704/230
5,805,222 A * 9/1998 Nakagawa et al. .... 375/240.12
5,978,762 A 11/1999 Smyth et al.
5,990,957 A * 11/1999 Ryoo ..... 375/240.03
6,185,253 B1 * 2/2001 Pauls ..... 375/240.02
6,363,338 B1 * 3/2002 Ubale et al. ..... 704/200.1
6,725,192 B1 * 4/2004 Araki ..... 704/230

OTHER PUBLICATIONS

Nakajima et al., "MPEG audio bit rate scaling on coded data domain," Proceedings of the 1998 IEEE International Conference on Acoustics, Speech and Signal Processing, May 1998, vol. 6, pp. 3669-3672, no day.
Aggarwal et al., "Trellis-based optimization of MPEG-4 advanced audio coding," Proceedings 2000 IEEE Workshop on Speech Coding, Sep. 2000, pp. 142-144, no day.

* cited by examiner

*Primary Examiner*—W. R. Young
*Assistant Examiner*—Huyen X. Vo
(74) *Attorney, Agent, or Firm*—Rosenberg, Klein & Lee

(57) ABSTRACT

A method for an improved QSS (bit allocator) algorithm is disclosed. The disclosed method is capable of greatly improving determination time; thereby, improving the efficiency of converting a signal from an audio format to an MP3 format. The starting point of the QSS determination for a present frame (N) is the QSS of a previous frame (N−1). This starting point provides for improved efficiency for determining actual QSS of frame N as QSS[N−1] will be closer to QSS[N] than an arbitrary starting point. Thus, fewer iterations are required to determine QSS[N] as compared to conventional encoders. The algorithm of the present is more efficient than conventional methods in that it makes use of the fact that audio signal statistics usually do not change abruptly during the period of one audio frame to another.

3 Claims, 3 Drawing Sheets

FAST CONVERGENCE METHOD FOR BIT ALLOCATION STAGE OF MPEG AUDIO LAYER 3 ENCODERS

CROSS REFERENCES TO RELATED APPLICATIONS

This application claims the benefit of U.S. Provisional Application No. 60/183,764 filed Feb. 18, 2000.

FIELD OF THE INVENTION

The present invention generally related to MPEG audio layer 3 (MP3) encoders and, more particularly, to the bit allocation algorithm used to determine the quantization step size of an audio signal transferred by MP3 devices.

BACKGROUND OF THE INVENTION

As illustrated in FIG. 1, conventional MP3 encoders 10 employ four main components. A filter bank 12 is used to convert an input audio signal (in the time domain) to the frequency domain. A psychoacoustic model 16 is generally used to determine which components of the input signal can be removed (or transmitted with less accuracy) based on the characteristic of the human ear. A "bit allocator" (Bitstream formatting) 14 component calculates the quantization step size (QSS) of the input signal and other scale factors for each frequency band within the input signal. Broadly speaking, the bit allocator provides the output signal of the encoder with all of the non-important signal frequencies filtered out. The "bitstream formatter" (bitstream formatting) component 18 is the final component of the encoder which provides the signal that is suitable for transmission in compressed form (i.e. over the Internet).

The drawback with conventional encoders is that a tremendous amount of time is spent determining the quantization step size of the frequency components of the signal that is to be transmitted. As much as 30% of the encoding time is spent calculating the quantization step size. The longer the CPU is working, the more inefficient the encoding process is. Consequently, the conversion time from original audio formal to MP3 format is increased. What is needed is to reduce this large encoding time.

The QSS is determined by performing an iterative process. FIGS. 2 and 3 show iteration loops for the iterative process of the conventional encoders. FIG. 2 shows the conventional Outer Iteration Loop 20. A first step of Outer Iteration loop 20 is an inner iteration loop 24. Inner Iteration loop 24 is as shown on FIG. 3. In Step 26, the distortion for each critical band is calculated. In Step 28, the conventional method saves the scaling factors of the critical bands. Proceeding to Step 30, preemphasis is performed. In Step 32, the method amplifies critical bands with more than the allowed distortion. In Step 34, the determination is made whether all critical bands are amplified. If all critical bands are amplified, then Step 40 is performed wherein the scaling factors are restored. If all critical bands have not been amplified, then the loop proceeds to Step 36. In step 36, a determination is made whether the amplification of all bands is below the upper limit. If this is not true, then Step 40 is performed. If the amplification of all bands is below the upper limit, then the loop proceeds to Step 38. In Step 38, a determination is made as to whether there is at least one band with more than the allowed distortion. If there is not at least one such band, then Step 40 is performed. If there is at least one such band, then the loop proceeds back to Step 24.

FIG. 3 shows the conventional Inner Iteration Loop 24. Quantization is shown at Step 242. In step 244, there is a determination as to whether the maximum of all the quantized values are within the table range. If this is true, the loop proceeds to Step 246 wherein quantizer step size is increased, then proceeds back to the beginning of the loop. If the maximum of the quantized values is not within the table range in Step 244, then the loop proceeds to Step 248. In Step 248, the runlength of zeros at the upper end of the spectrum is calculated. Proceeding to Step 250, there is a calculation of the runlength of values less or equal one at the upper end of the spectrum. In Step 252, there is a bit count for the coding of values less or equal one on the upper end of the spectrum. In step 254, the rest of the spectral values are divided into three sub regions. In Step 256, the code table is chosen for each sub region. Proceeding to Step 258 there is a bit count for each sub region. In Step 260, a determination is made as to whether the overall bit sum is less than the available bit. If the overall bit sum is not less than the available bit, the loop proceeds to Step 262 where quantizer step size is increased before proceeding to the beginning of the loop at Step 242. If, for Step 260, the overall bit sum is less than the available bit, then the loop is completed and, at Step 264, there is a return back to the Outer Iteration Loop 20, shown in FIG. 2.

SUMMARY OF THE INVENTION

The present invention is directed to an improved QSS (bit allocator) algorithm which greatly improves determination time, thereby improving the efficiency of converting a signal from an audio format (i.e. PCM) to an MP3 format. The starting point of the QSS determination for a present frame (N) is the QSS of a previous frame (N−1). This starting point provides for improved efficiency for determining actual QSS of frame N as QSS[N−1] will be closer to QSS[N] than an arbitrary starting point. Thus, fewer iterations will be required to determine QSS[N] as compared to conventional encoders. The algorithm of the present invention is more efficient than conventional methods in that it makes use of the fact that audio signal statistics usually do not change abruptly during the period of one audio frame to another.

DETAILED DESCRIPTION OF THE INVENTION

Figure 1:
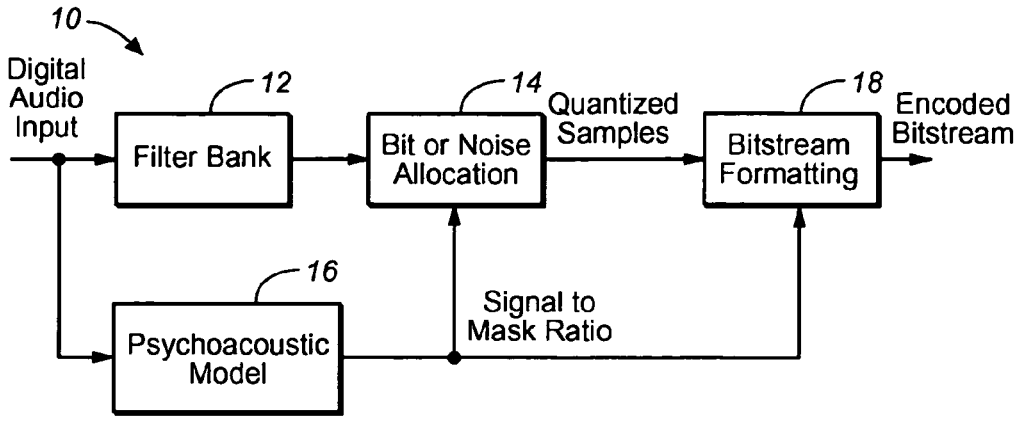
FIG. 1 (PRIOR ART)
FIG. 1 is a schematic diagram illustrating the components of an MP3 encoder.
Figure 4:
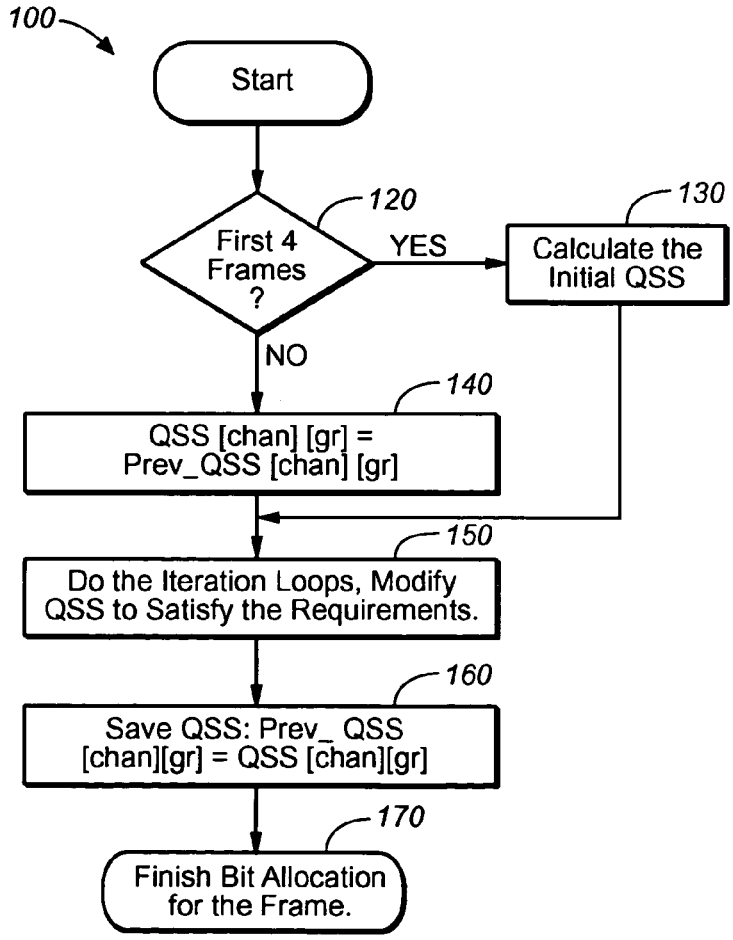
FIG. 4 is a flow chart illustrating the quantization step size determination algorithm according to the present invention.
Figure 2:
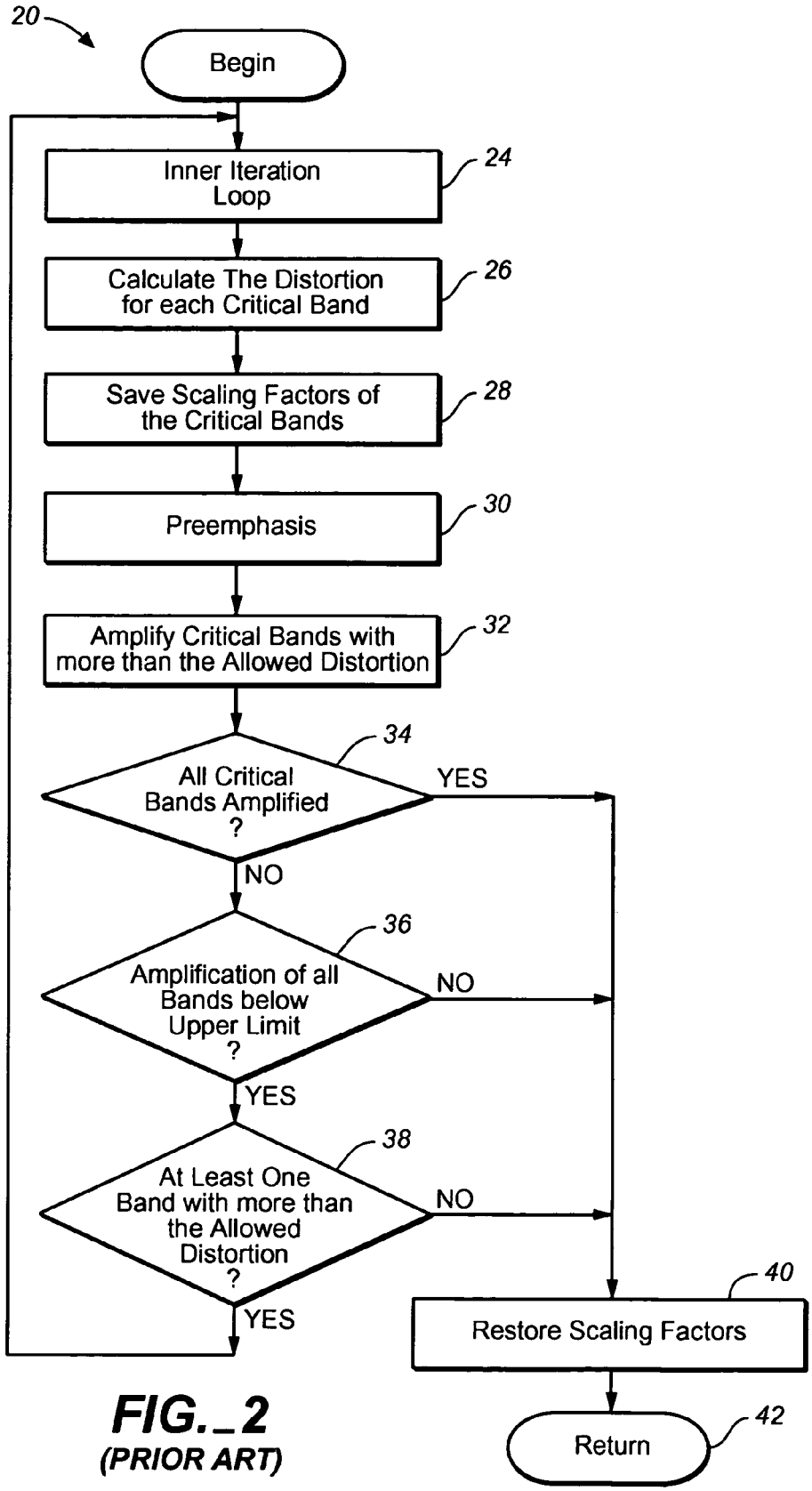
FIG. 2 (PRIOR ART)
FIGS. 2 and 3 are flow charts illustrating the conventional encoding algorithm.
Figure 3:
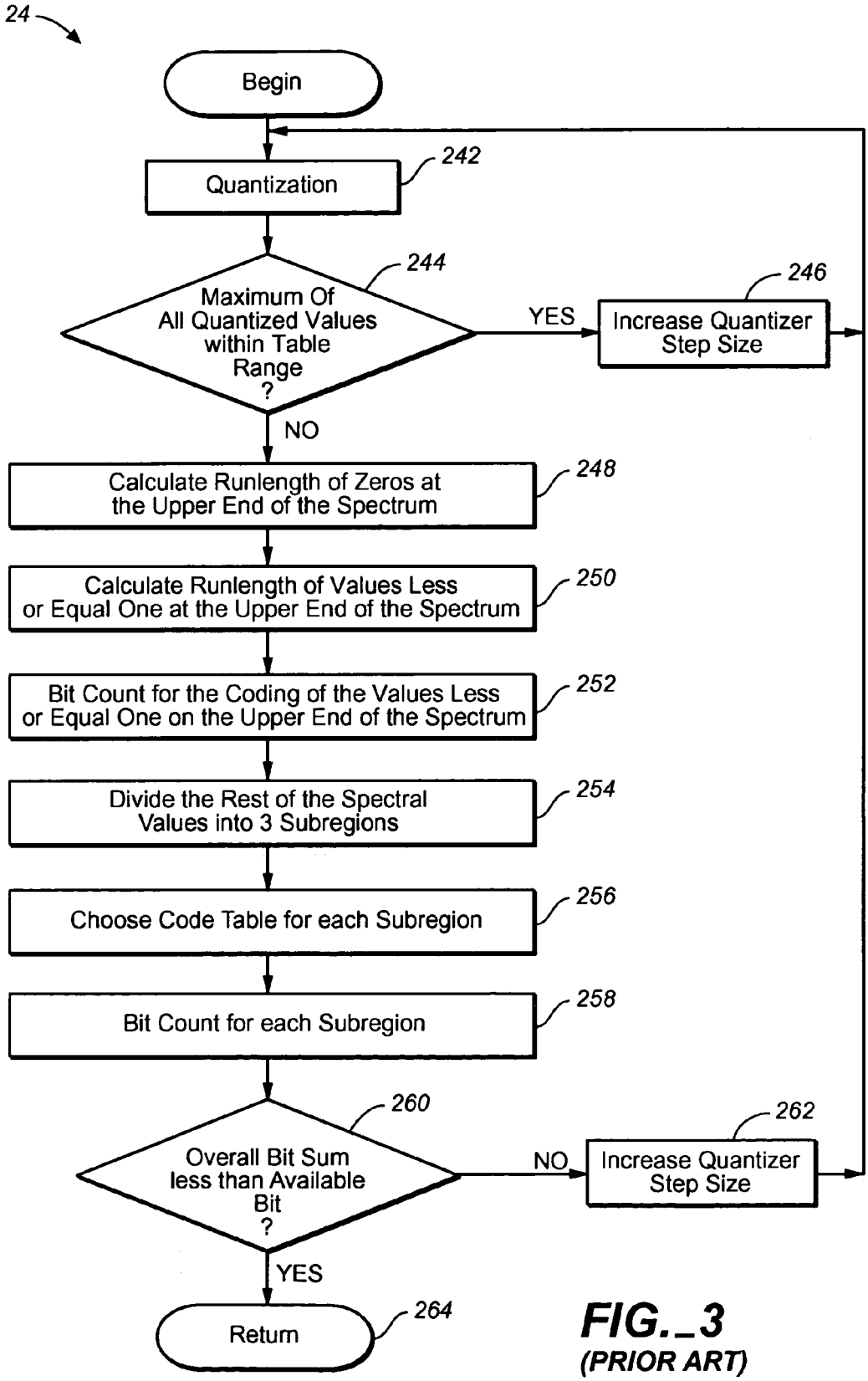
FIG. 3 (PRIOR ART)

The improved bit allocator algorithm of the present invention utilizes the fact that audio signal statistics usually do not change abruptly during the period of one audio frame to another. Thus, as shown in FIG. 4, the determination method 100 of the present invention starts at Step 120 by determining if the first N frames of an audio signal have been sampled. In an exemplary embodiment, N=4. If the first N4 frames are being encoded, then proceeding to Step 130 the method calculates the QSS of those frames using a conventional quantization process. Next, in Step 140, the QSS of the previous frames is used to determine the QSS of the frame to be encoded. However, unlike conventional QSS determination processes, the initial point of the determination is provided by the previously calculated QSS[N−1]. QSS[N−1] is shown as QSS[chan][gr] in FIG. 4; where [N−1] represents the frame wherein "chan" (channels) and "gr" (granules) are found for the MPEG audio layer 3 standard as is well known in the art. At Step 150 in FIG. 4, iterative determination loops are then performed and the QSS[N] is modified to satisfy the requirements of the larger encoding system. One skilled in the art would recognize that the iterative determination loops in Step 160 for the present invention would differ from the conventional loops shown in FIGS. 2 and 3 due to the initial point being determined by the previously calculated QSS. For instance, it is well known that to converge from a non-zero initial point, might require decreasing the QSS.

In Step 160, the modified QSS[N] from Step 150 is then stored and used as the initial point of the next iterative determination QSS[N+1]. Step 170 shows the finish for bit allocation for the frame. It has been determined by the inventors that the bit allocator algorithm of the present invention requires ⅓ less computation time to complete as compared to conventional algorithms. Thus, the encoding time and signal throughput is greatly enhanced.

While the present invention has been particularly described with respect to the illustrated embodiment, it will be appreciated that various alterations, modifications and adaptations may be made based on the present disclosure, and are intended to be within the scope of the present invention. While the invention has been described in connection with what is presently considered to be the most practical and preferred embodiments, it is to be understood that the present invention is not limited to the disclosed embodiments but, on the contrary, is intended to cover various modifications and equivalent arrangements included within the scope of the appended claims.

What is claimed is:

1. A method for determining quantization step size (QSS) forte bit allocator component of an MPEG audio Layer 3 (MP3) encoder comprising the steps of:

(a) determining if the first N frames of an audio signal have been sampled and are to be encoded;

(b) if the first N frames are to be encoded, then calculating the QSS of those frames using a conventional quantization process;

(c) if the first N frames have already been encoded, ten setting the QSS of a frame to be encoded to the calculated QSS of the previous frame;

(d) performing iterative determination loops to modify QSS, wherein the requirements of the MP3 standard are satisfied; and (e) storing the modified QSS, wherein said modified QSS is used as the initial point of the next iterative determination;

wherein the quantization step in steps (a)–(b) is calculated differently from the quantization step in steps (c)–(e).

2. A method for determining quantization step size (QSS) for the bit allocator component of an MPEG audio Layer 3 (MP3) encoder comprising the steps of:

(a) determining if the first four frames of an audio signal are being encoded;

(b) if the first four frames are being encoded, then calculating the QSS of those frames using a conventional quantization process;

(c) if the first four frames have been encoded, then using the QSS of the previous frame to determine the QSS of a frame to be encoded;

(d) performing iterative determination loops and modifying the QSS, wherein the requirements of the MP3 standard are satisfied;

(e) storing the modified QSS and using the modified QSS as an initial point of the next iterative determination; and (f) finishing bit allocation for the frame;

wherein the quantization step of the first 4 frames is calculated differently from the quantization step of remaining frames.

3. A method for determining quantization step size (QSS) for the bit allocator component of an MPEG audio Layer 3 (MP3) encoder comprising the steps of;

(a) determining a number of a frame to be encoded;

(b) if the number of the frame is less than five, then calculating the QSS of those frames using a conventional quantization process;

(c) if the number of the frame is five or greater, then using the QSS of the previous frame to determine the QSS of a frame to be encoded;

(d) performing iterative determination loops and modifying the QSS, wherein the requirements of the MP3 standard are satisfied;

(e) storing the modified QSS and using the modified QSS as an initial point of the next iterative determination; and (f) finishing bit allocation for the frame;

wherein the quantization step of the first four frames is calculated differently from the quantization step of remaining frames.

* * * * *